United States Patent [19]

Fayard

[11] Patent Number: 4,606,309

[45] Date of Patent: Aug. 19, 1986

[54] DEVICE FOR CONTROLLING THE COMBUSTION CHAMBERS EXHAUST AND/OR INTAKE FOR INTERNAL COMBUSTION ENGINES

[75] Inventor: Jean-Claude Fayard, Lyons, France

[73] Assignee: Elf France, Paris, France

[21] Appl. No.: 696,764

[22] Filed: Jan. 31, 1985

Related U.S. Application Data

[63] Continuation-in-part of Ser. No. 517,030, Jul. 25, 1983, Pat. No. 4,506,636.

[30] Foreign Application Priority Data

Feb. 3, 1984 [FR] France ..... 84 01675
Jan. 17, 1985 [FR] France ..... 85 00637

[51] Int. Cl.[4] ..... F01L 7/16
[52] U.S. Cl. ..... 123/190 DL; 123/190 BD; 123/190 E
[58] Field of Search ..... 123/190 DL, 190 E, 190 A, 123/190 BA, 190 BD, 80 BA

[56] References Cited

U.S. PATENT DOCUMENTS

| | | | |
|---|---|---|---|
| 1,618,603 | 2/1927 | Porter | 123/190 E |
| 1,649,486 | 11/1927 | Porter | 123/190 E |
| 1,977,025 | 10/1934 | Elstt et al. | 123/190 BD |
| 3,948,227 | 4/1976 | Guenther | 123/190 DL |
| 4,008,694 | 2/1977 | Monn | 123/190 E |
| 4,098,514 | 7/1978 | Guenther | 123/190 E |
| 4,313,401 | 2/1982 | Monn | 123/190 E |
| 4,506,636 | 3/1985 | Negre et al. | 123/190 E |

FOREIGN PATENT DOCUMENTS

| | | | |
|---|---|---|---|
| 902918 | 7/1949 | Fed. Rep. of Germany | 123/190 E |
| 1145762 | 1/1956 | France | 123/190 BD |

*Primary Examiner*—Magdalen Y. C. Greenlief
*Attorney, Agent, or Firm*—Burgess, Ryan & Wayne

[57] ABSTRACT

Device for controlling the circulation of gases from and towards an internal combustion engine, wherein a sealing ring is provided with means for injecting a lubricating and cooling liquid such as oil in the gap between a continuous sealing surface around a passage within a sealing ring and the external surface of a rotary throttle, this device being applied to the high pressure and high temperature sealing of rotary throttle for four stroke engines.

17 Claims, 13 Drawing Figures

DEVICE FOR CONTROLLING THE COMBUSTION CHAMBERS EXHAUST AND/OR INTAKE FOR INTERNAL COMBUSTION ENGINES

REFERENCE TO RELATED APPLICATIONS

This Application is a continuation-in-part of copending U.S. patent application No. 517,030, filed July 25, 1983, and issued on Mar. 26, 1985 as U.S. Pat. No. 4,506,636.

BACKGROUND OF THE INVENTION

1. Field of the invention

The present invention concerns a device for controlling the circulation of gases from and towards an internal combustion engine chamber, in particular a reciprocating or rotary two stroke or four stroke engine, comprising a throttle or rotor comprising grooves or a lateral notch defining the respective transverse exhaust or intake passages. In combustion engines fitted with this type of distribution, the throttle carries out a continuous revolving movement synchronized with the rotation of the engine around an axis parallel to the axis of rotation of the engine in order to carry out successive phases of the engine cycle by connecting to the exhaust, and where necessary, to the intake, a passage directly connected to the combustion chamber.

2. Description of the Prior art

According to a known embodiment of this type of engine (French patent applications Nos. 83 12071 and 82 12072) for operation at high speeds of rotation, the throttle is contained within a transverse bore into which emerges an orifice directly connected to the combustion chamber, with the intake and/or outlet orifices respectively connected to an exhaust collector. The passage connected to the combustion chamber is provided with a sealing ring housed in a bore and pushed on the throttle by a continuous sealing surface around the orifice directly connected to the combustion chamber under the application of the pressure prevailing in the combustion chamber, and surrounded by one or several sealing elements such as piston rings, this sealing ring being able to slide within the bore and its stroke being limited, on the one hand, by the throttle, and, on the other hand, by a retaining shoulder.

Such combustion engines appear adapted to deliver much higher power to weight ratios than known and tested solutions, in particular for small cubic capacity engines, due to the absence of distribution pieces subjected to a reciprocating movement causing a pulsation limit frequency. The most important advantage of this type of distribution lies in the possibility of having exhaust and intake pipes whose diameter is twice as great as a standard valve system, thus allowing to obtain an improved air filling and thus a much higher specific power.

After a thorough initial testing of the rotary throttle distribution devices, it appeared that these distribution rotor systems presented operating drawbacks or defects that did not enable the advantages mentioned hereinabove to be fully worked.

Among these various drawbacks should be cited the difficulties of ensuring the lubrication and the cooling of the sealing elements, which causes excessive wear of the throttle and of the sealing elements and members, high oil consumption, and which can lead, in certain limit cases, to the seizing of the throttle within its bore.

Furthermore, when the distribution by rotary throttle is applied to four stroke engines, no decrease of the specific motor-fuel consumption is observed with respect to engines operating according to a two stroke cycle. This over-consumption of motor-fuel is apparently due to an insufficient separation of the pipes or of the intake and exhaust phases which provoke:

a dilution of the fresh gases by the exhaust gases which is shown by the poor combustion and increased pollution;

an introduction of the vaporized fuel in the exhaust gases also causing an increase in both pollution and the motor-fuel specific consumption.

SUMMARY OF THE INVENTION

One of the aims of the present invention is precisely to overcome these defects of rotary distribution combustion engines in order to utilize large passage sections that permit this type of valve actuation without risking rapid wear and excessive motor-fuel consumption.

With this purpose, according to a first embodiment of the invention, the sealing ring is provided with means for injecting a lubricating and cooling liquid, such as oil in the gap between the unbroken sealing surface of the ring around the orifice and external surface of the throttle.

These fluid injection means are preferably constituted, on the one hand, by an annular intake chamber defined between the periphery of the sealing ring and its bore and axially limited at each end by a packing interposed between the external surface of the sealing ring and the bore and, on the other hand, at least one intake passage presenting an exit orifice emerging in said gap between the unbroken sealing surface and the external surface of the throttle. At least, the packing interposed between the external surface of the sealing ring and its cooperating bore is thus protected from heat of the burned gases in the combustion chamber by at least one fire ring interposed between the sealing ring and its bore and between the said packing and the combustion chamber.

The output orifice of the intake passage can emerge into an unbroken feed distribution groove provided inside the contact surface of the sealing ring with the throttle.

According to another embodiment of the device, the fluid injections means comprise means for regulating the fluid flow such as loss of head provoked by the reduced section of the intake pipes of the fluid or by another loss of head means such as a constriction or throttling which is interposed therein.

Alternately, the loss of head means can be constituted by a porous annular cartridge emerging onto the said gap and interposed between this gap and at least one intake orifice of the pressurized lubricating fluid and the cartridge is made of any material presenting good rubbing properties with the external surface of the throttle, such as sintered bronze.

When the device for controlling the circulation of the gases from and towards the engine combustion chamber is applied to a combustion engine operating according to a four stroke cycle with introduction of the motor-fuel prior to injection of the combustion air, scraper means of the lubricating fluid injected into the gap are disposed around the intake orifice connecting the throttle to the combustion air and motor-fuel intake, these scraper means being constituted by an intake sealing ring disposed at the periphery of the said intake orifice, continuously abutting upon the external surface of the throttle and adapted to shut the inside of the intake orifice of the gap between the throttle and its bore in order to limit the carrying along of the oil and/or liquid motor-fuel to the surface of the rotating throttle. The sealing ring is, on the one hand, made of a soft material having good rubbing qualities with the surface of the throttle such as plastic material, and on the other hand, continuously pushed against the surface of the throttle under a substantially constant pressure by a spring.

According to another embodiment, the throttle comprises two separate intake and exhaust pipes respectively, that are intended to emerge successively, through rotation of the throttle, on the side of the combustion chamber, onto the sealing ring, and from the opposite side onto output orifices that are each shifted on the axis of the throttle with respect to the sealing ring, in such a way as to reduce the carrying along of the motor-fuel on the surface of the rotating throttle and of the motor-fuel carried along at the intake in the intake passage provided inside the throttle.

According to a particularly advantageous disposition for multicylinder engines, the separate intake or exhaust passages of two adjacent combustion chambers are provided in the throttle and emerges into an orifice communicating with the intake or the exhaust and which is common to the two adjacent combustion chambers in such a way as to reduce the number of openings to be foreseen on the external surface of the throttle.

According to another disposition applied to a combustion engine operating according to a four stroke cycle, the admission circuit of the combustion chamber comprises means of suppressing the motor-fuel within the air inducted into the combustion chamber at the end of intake, in order to limit the quantity of motor-fuel introduced into the intake passage provided in the throttle, and which has not entered within the combustion chamber during the induction phase. In the case where the motor-fuel is introduced through injection into the intake air, the above-mentioned suppression means are constituted by interrupting the motor-fuel injection well before the end of the induction phase.

In the case when the motor-fuel is introduced into the combustion chamber through a carburettor, the above-mentioned suppression means are thus, preferably, constituted by at least one auxiliary passage of fuel enriched air such as an emulsion, provided in the throttle and the cylinder head of the combustion chamber and the auxiliary passage emerges onto the gap between the throttle and its bore at a point where it is shut by the rotation of the throttle prior to the main intake aperture(s) being in turn obturated.

According to one variant of the device according to the invention, an end portion of at least one supply member of one of the combustion elements, such as a spark plug for a controlled ignition engine or an injector and/or a heat plug for a diesel engine, sealingly passes through the transversal section of the sealing ring in order to emerge into the passage that is connected to the combustion chamber, and the adjacent portion of the said end is housed with an annular clearance in a passage issuing towards the outside of the wall of the cylinder head of the combustion engine. This passage, which is connected to the combustion chamber thus fulfills the function of the main part of the combustion chamber.

According to another variant of the device according to the invention, the passage giving rise to the annular clearance is through-crossed by a cooling liquid. Preferably, the cooling liquid is constituted by the lubricating and refrigerating liquid conveyed by the injection means.

According to a further variant of the device according to the invention, the passage giving rise to the annular clearance is extended towards the outside by an enlarged annular chamber, the said annular chamber being sealed off by a resilient annular seal packing which is interposed between the supply member and the internal wall of the said chamber and which defines a cooling chamber through-crossed by the lubricating and cooling liquid conveyed by the injection means. This enlarged part allows access for a tool to work on the said feed element.

BRIEF DESCRIPTION OF THE DRAWING

Other aims, advantages and objects of the control device according to the invention will become apparent through reading the following description of various embodiments, given by way of non-limitative illustration with reference to the appended drawing in which.

DESCRIPTION OF THE PREFERRED EMBODIMENTS

Figure 1:
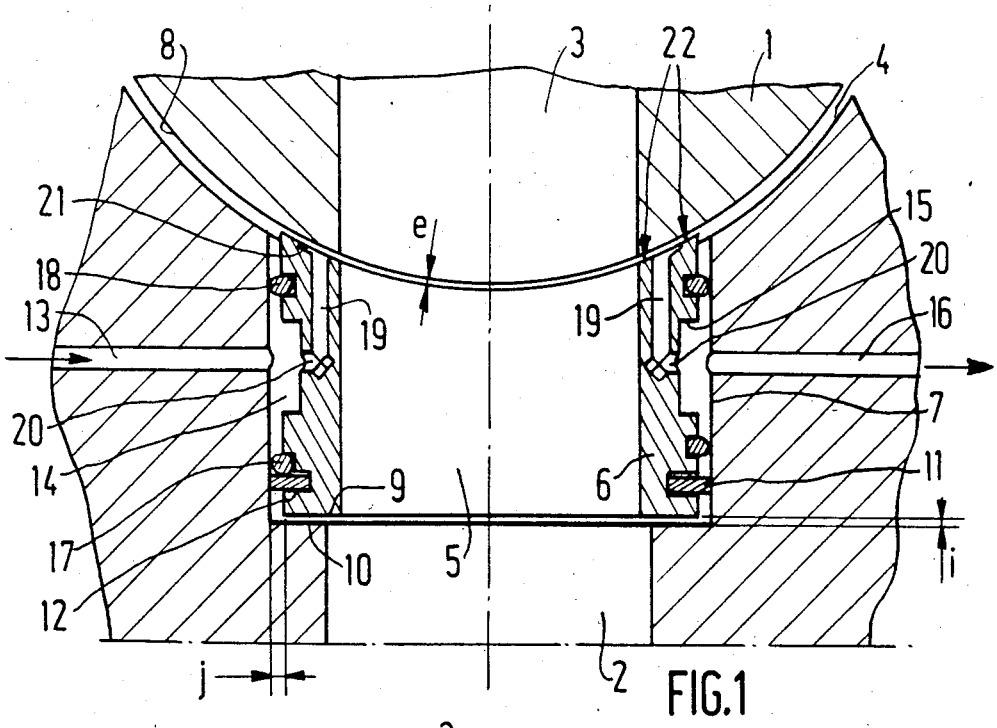
FIGS. 1 and 2 are cross-section views on a larger scale of two embodiments of the sealing system according to the invention between a revolving distribution throttle and an engine combustion chamber.
Figure 2:
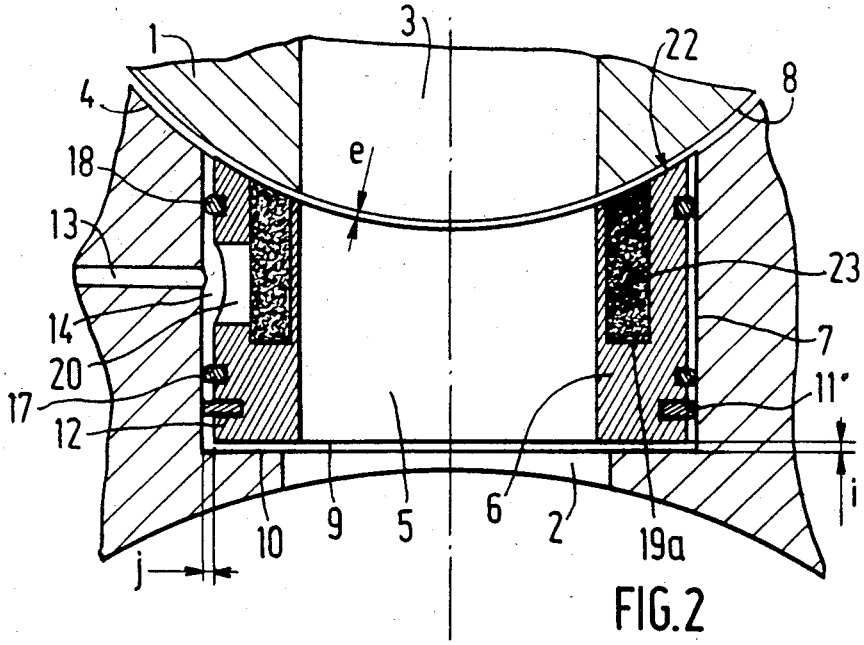

FIGS. 1 and 2 show a rotary throttle 1 for controlling the exhaust of a combustion chamber 2 of a combustion engine which is represented at the instant when its internal exhaust duct 3 is open wide on combustion chamber 2. Throttle 1 revolves, continuously and in synchronization with the rotation of the engine, in a bore and exhaust duct 3 is connected to combustion chamber 2 through a passage 5 of relatively wide dimension provided in a sealing ring 6 that can slide freely within a bore 7 having an axis substantially parallel to that of the engine cylinder (not represented) or substantially perpendicular to the axis of rotation of the throttle 1, in such a way as to ensure a good bearing of the contact surface of ring 6 with the external surface 8 of the throttle 1. Contact surface 22 between ring 6 and throttle 1 is established on a strip of small width according to the general intersection line of two cylinders (the external surfaces of throttle 1 and ring 6 of different diameters and with substantially perpendicular and converging axes). According to one known disposition which is particularly efficient since it regulates in proportion the application effort of sealing ring 6 on throttle 1 to the pressure to be sealed, sealing ring 6 which is displaced by soft rubbing in its bore 7 is pushed onto the external surface 8 of throttle 1 through the single pressure prevailing within combustion chamber 2 and acting upon its annular section, increased wherever necessary by the thrust of a low reaction force spring such as a resilient washer. The presence of this thrust spring (not represented) of ring 6 on throttle 1 is not indispensable if only a small clearance or gap i exists between end 9 of ring 6 on the side of combustion chamber 2 and a holding shoulder 10 provided at the end of bore 7 receiving the ring 6. Furthermore, the temperature being relatively high in the gap i due to the proximity of combustion chamber 2, the time history of the behaviour of a spring member is rather unsatisfactory. In order to suppress leaks in gap j between the external surface of ring 6 and the inside of bore 7, a fire piston ring 11 is disposed in a manner known per se in this gap j and is borne by a groove 12 provided preferably within ring 6. Piston ring 11 also prevents over-heating of gap j in the direction of throttle 1 and the formation in this gap of deposits that will finally result in clogging ring 6 in its boring 7.

According to the invention, sealing ring 6 is provided with means for injecting a lubricating and cooling liquid, preferably the oil for lubricating the engine pressurized by the oil pump of the engine, in the gap e between unbroken sealing surface 22 (according to the orthogonal general intersection line of two cylinders having different diameters) around duct 3 provided in throttle 1 and external surface 8 of throttle 1.

According to the device represented in FIG. 1, the fluid injection means comprise a pressurized oil intake duct 13 connected to the lubricating pump of the engine and emerging onto an annular distribution chamber 14, defined in gap j between the periphery of ring 6 and its bore 7, for example, by means of a circular groove 15 provided at the periphery of sealing ring 6. According to one disposition easing the cooling of ring 6, chamber 14 can be through-crossed by a large flow of oil being directed towards another element to be lubricated or exit by an outlet pipe 16. Chamber 14 is defined in gap j by two annular seals 17 and 18 disposed respectively on the side of combustion chamber 2 and on the side of throttle chamber 1. Annular seals 17 and 18 are preferably made of a resistant elastomeric material for seals housed by elasticity in the annular grooves provided at the external surface of ring 6 since the fire piston ring 11 and the circulation of the oil protect them against an excessively high temperature.

Oil distribution chamber 14 is connected to gap e between the sealing surface of ring 6 and external surface 8 of throttle 1 through feed passages 19 realized preferably by a longitudinal drilling in the thickness of the ring, connected to a transverse drilling 20 from the bottom of the circular groove 15. Intake passages 19 can emerge into 9ap e directly through an output chamfer or indeed an unbroken annular distribution groove 21 provided inside the contact surface or sealing surface 22 of ring 6, in order to better spread out the oil through gap e. It should be noted that pipe 3 provided inside rotary throttle 1 can be an intake pipe for fresh gas (normally pressurized or atmospheric air) carburated or not, or indeed an exhaust pipe for combustion gas such as described herein-above and that pipe 3 can be replaced, as will be seen herein-below, by a lateral notch fulfilling successively during rotation of the throttle, the functions of intake passage then exhaust passage.

Operating of the control device for the circulation of gases from and/or towards an engine combustion chamber, such as represented in FIG. 1 will now be described in length. Once the engine is set in rotation, it drives throttle 1 in synchronous rotation and brings about an oil pressure that is transmitted to distribution chamber 14 and to annular groove 21 in order to cause to flow a thin layer of oil between sealing surface 22 of ring 6 and the mobile external surface 8 of throttle 1.

The pressure prevailing in combustion chamber 2 during compression and combustion phases of the gases strongly applies sealing surface 22 onto external surface 8 of throttle 1 and reduces the thickness of this oil layer to a minimal value just sufficient to ensure a film of oil between the surface of throttle 1 and sealing surface 22. During these scavenging and induction phases (for the running of the four stroke engine) when the pressure in combustion chamber 2 is close to atmospheric pressure or slighly above (the case of pressure loaded engine), the friction hysteresis of the fire piston ring 11 of ring 6 on throttle 1 maintains a significant residual application force of ring 6 on throttle 1. This residual force limits the oil leaks between sealing surface 22 and surface 8 of the throttle to a just sufficient flow to ensure a continuous oil film between surface 8 of throttle 1 and its guiding bore 4. When duct 3 inside throttle 1 is an exhaust duct, the oil leaks towards the inside passage 3–5 and carried towards the exhaust and thus lost, whereas when duct 3 is an intake duct, the oil leaks towards passage 5 and brought back into combustion chamber 2 and thus at least partly re-used.

Due to the continuous lubrication of gap e, the wear of sealing surface 22 of ring 6 is reduced to a minimal value and the risks of seizing at high speed of ring 6 on throttle 1 are suppressed. The surface temperature of throttle 1 (furthermore, generally internally cooled by a longitudinal circulation of water) is considerably reduced and the sealing between the throttle and its bore 4 is ensured by an oil corner. The circulation in derivation of oil between intake pipe 13 and outlet pipe 16 ensures forceful cooling of sealing ring 6 that could thus in certain application cases be realized in a relatively soft material having good rubbing properties such as a high resistance moulded plastic material.

Sealing ring 6 as well as throttle 1 could be preferably made of different rubbing couples that are currently utilized in engines such as: cast iron/chromium, cast iron/cast iron, etc., but also made of novel composite materials, ceramics or other novel products. A calibrated orifice (not represented) can be disposed on intake pipe 13 or on intake passages 19 in order to limit the oil flow escaping from gap e when the loss of head provoked by intake passages is insufficient to limit the leak flow of the oil.

In the embodiment represented in FIG. 2, identical elements to those represented in FIG. 1 bear the same reference numerals. Unlike FIG. 1, sealing ring 6 can be made of porous sintered metal with a sealing plating on the surfaces which must not give rise to an oil exsudation, or indeed as represented in FIG. 2, an annular ring or filter 23 made of porous sintered metal, such as bronze, is introduced or moulded in a blind recess 19*a* longitudinally provided in sealing ring 6. This porous ring 23 is connected by at least one lateral passage 20 to oil pressure distribution chamber 14. Porous ring 23 thus operates as a loss of head and oil distribution member in gap e and as a good quality rubbing member reducing the friction between ring 6 and rotary throttle 1. This disposition which appears suitable for the cases where the rotation speed of throttle 1 is moderated and where a forceful cooling of sealing ring 6 is not required, diminishes the oil losses and generally is more economic to operate than the solution represented in FIG. 1.

Figure 3A:
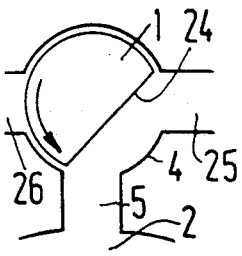
FIGS. 3*a* to 3*c* schematically illustrate the principal positions during an engine cycle of a throttle distribution system applied to a four stroke engine.
Figure 3B:
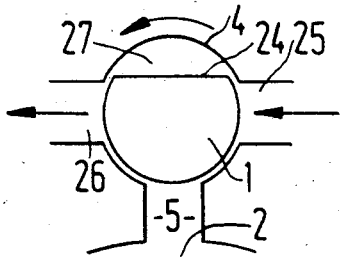
Figure 3C:
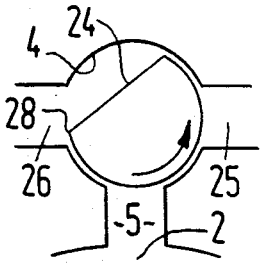

FIGS. 3*a* to 3*c* schematically represent the most characteristic positions of a throttle 1 provided, not with an internal duct, but with a notch 24 intended to ensure the distribution (induction and exhaust) of a combustion chamber 2 of a four stroke internal combustion engine. From FIG. 3*a*, it can be seen that notch 24 connects combustion chamber 2 of the engine (via a sealing ring of the type described in FIGS. 1 and 2 and not represented) to an intake duct 25 provided with motor-fuel feeding means such as a carburetor or an injector, if the engine operates with a controlled ignition. In FIG. 3*b*, throttle 1 has revolved in the trigonometric direction and shuts off both intake pipe 25 and exhaust pipe 26. It will be seen that notch 24 of throttle 1 defines with guiding bore 4 of throttle 1 a passage chamber 27 of a significant volume and which is thus shut off from intake and exhaust. Chamber 27 has been filled during the intake phase by air relatively rich in motor-fuel since inducted after the walls of the intake pipe have been saturated by liquid motor-fuel. It can be seen from FIG. 3*c* that the motor-fuel rich air contained in passage chamber 27 is completely discharged at exhaust 26, especially following the arrival of the blast of exhaust gas when combustion chamber 2 is put into communication (not represented) with chamber 27 when the edge 28 of notch 24 emerges on passage 5 connected to combustion chamber 2.

Another motor-fuel overconsumption source when the engine equipped with a rotary distribution throttle operates according to a four stroke cycle with carburated air intake, lies in the fact that the liquid motor-fuel that flows on the intake walls and progressively evaporates towards the combustion chamber, is carried along to the surface of throttle 1 towards exhaust 26 where the hot gases evaporate it and carry it in pure loss in the exhaust with the oil film deposited by the lubrication device represented on FIGS. 1 and 2.

Figure 4:
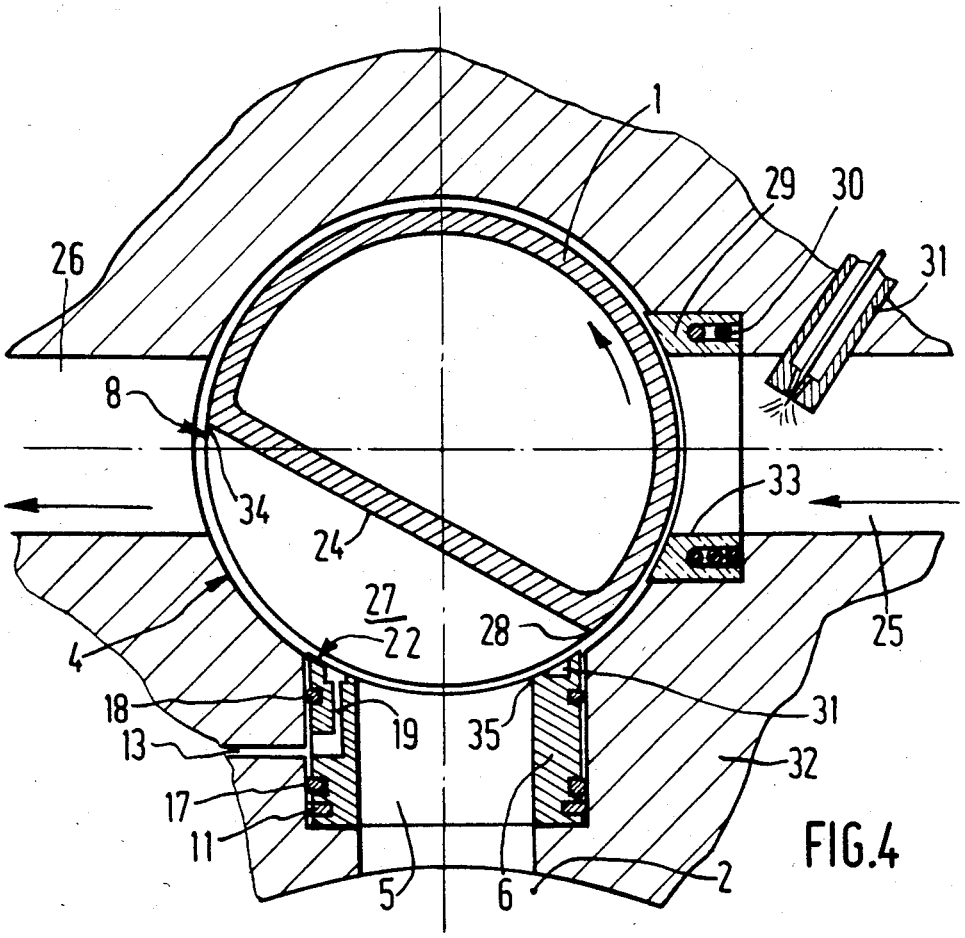
FIG. 4 is a cross-section view on a larger scale of the throttle distribution system schematically represented in FIGS. 3*a* to 3*c* and equipped with an intake sealing ring according to the invention.

FIG. 4 represents, on a larger scale, a solution allowing to reduce the motor-fuel and oil losses. Identical elements to those of FIGS. 1 to 3*c* bear the same reference numbers. In this embodiment, the oil scraper means are disposed around the air intake orifice on throttle 1. The scraper means are constituted by an intake sealing ring 29 permanently applied on surface 8 of throttle 1 by a spring 30. According to another embodiment, the motor-fuel feeding means herein constituted by a gasoline injector 31 are adjusted so that the injection is cut off well before the end of the intake phase of the combustion air. Packing ring 29 housed in the cooled cylinder head 32 of the engine and throughcrossed by the fresh intake gas is subjected neither to high temperatures, nor to great differences of pressure (the overpressures and vacuum are smaller than 1 bar) and consequently, they can be made of good rubbing quality plastic material such as Teflon.

The operating of the embodiments represented in FIG. 4 is described herein-below. Throttle 1 rotates in synchronization with the engine and receives from intake passages 19 and distribution groove 21 an oil film that is carried along to its surface 8. The oil film formed in the gap between the throttle and bore 4 is stopped by sealing ring 29 substantially of the same width as main sealing ring 6. The injection of the motor-fuel by injector 31 begins as soon as edge 28 of notch 24 emerges on internal passage 33 of sealing ring 29 and terminates well before the other edge 34 of notch 24 reaches straight edge 35 of the passage 5 provided inside ring 6 and cut off intake. From the beginning of the motor-fuel injection, a proportion of it is vaporized in the inducted air jet whereas the other terminates on the walls and is carried along towards combustion chamber 2 through progressive evaporation. Due to the interruption of injection well before the end of intake (while respecting quasi stoichiometric mixture conditions in combustion chamber 2), the walls only contain a small quantity of liquid motor-fuel at the moment of intake cutting off and passage chamber 27 is very lean in motor-fuel. The liquid motor-fuel that remains inside passage 33 is halted by the rubbing of sealing ring 29 and thus cannot be carried along towards the exhaust until the air intake resumes at the following intake cycle and carry along into combustion chamber 2 this liquid motor-fuel which is largely evaporated during the continuation of the engine cycle. The design such as represented in FIG. 4 considerably reduces the quantity of motor-fuel carried along directly to the exhaust and allow to carry out a four stroke engine cycle operating with a notch throttle and reasonable consumption while benefitting from clearly increased passage sections of the rotating throttle valve.

Figure 5:
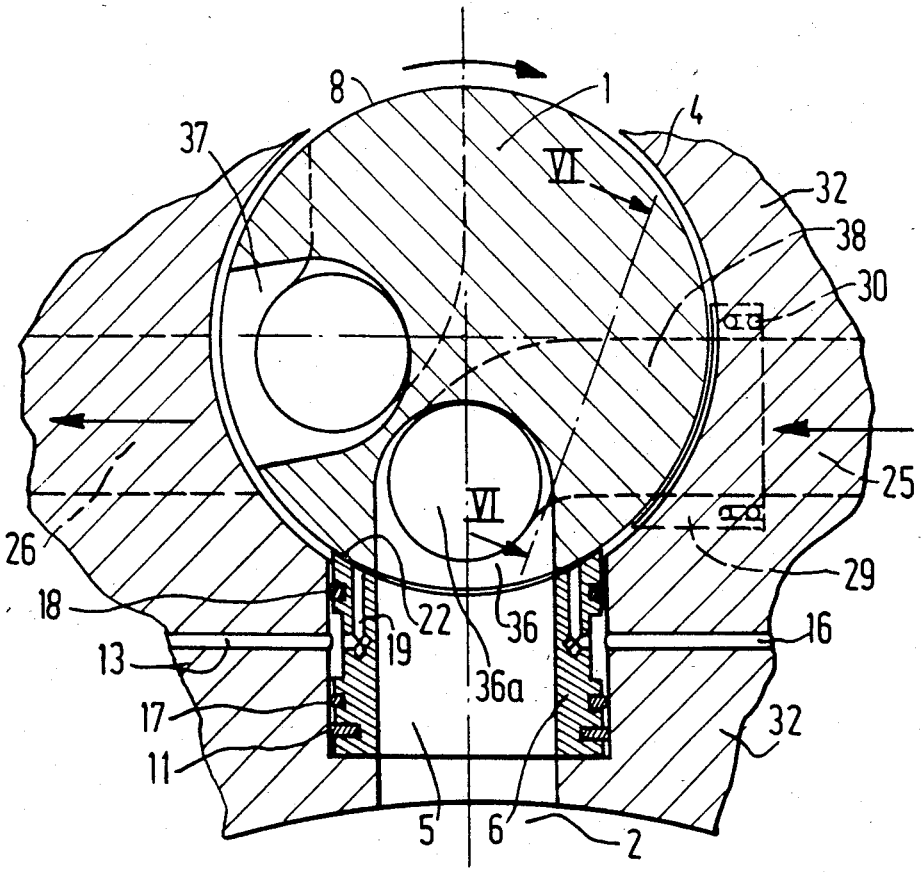
FIG. 5 is a cross-section view, again on a larger scale, of another embodiment of the throttle distribution system according to the invention comprising separate intake and exhaust pipes inside the throttle.
Figure 6:
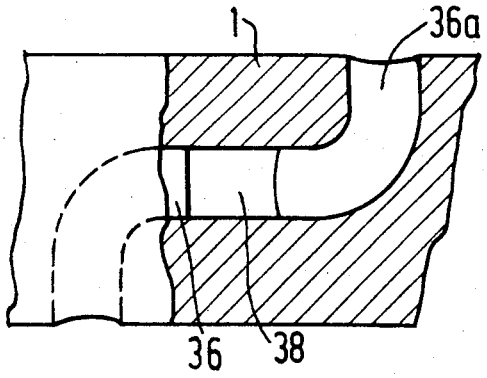
FIG. 6 is a cross-section view with torn away portions according to the line VI—VI of FIG. 5, of one part of the distribution throttle of an engine comprising several parallel cylinders.

Another embodiment of the device for controlling the circulation of the gas from and towards an engine combustion chamber is represented in FIGS. 5 and 6 where the elements and the members identical to those of the preceding bear the same reference numerals. In this embodiment, throttle 1 comprises separate intake and exhaust passages, respectively 36 and 37. Each of these passages emerges successively through rotation of throttle 1 at the side of combustion chamber 2 on sealing ring 6 and, on the opposite side, on orifices that are laterally shifted with respect to sealing ring 6. Intake passage 36 emerges at one side of the cylinder head on intake pipe 25 surrounded by its intake sealing ring 29. When throttle 1 has turned to assume full exhaust position, exhaust passage 37 emerges on passage 5 inside ring 6 and on exhaust pipe 26 shifted according to the axis of throttle 1 with respect to sealing ring 6.

According to the detail of the cross-section of FIG. 6, it can be seen that inside throttle 1, two intake passages 36 and 36*a* of two adjacent combustion chambers of an engine (in fact, of two parallel cylinders of an engine) emerge on a common communication orifice 38 with intake pipe 25 common to two cylinders.

This design which also applies to exhaust pipes and orifices allows to reduce the number of outputs to be provided in throttle 1 and cylinder head 32 and which constitute as many weakening zones of mechanical resistance of these members which are strongly stressed on the mechanical and thermal levels.

With further reference to FIG. 5, it will be understood that during rotation of engine and throttle 1, the passage chamber constituted by intake pipe 36 or the assembly of intake pipes 36–36*a* and 38, can confine the air relatively rich in motor-fuel but cannot be scavenged by the exhaust gas. The motor-fuel contained in intake passage 36 inside throttle 1 therefore remains in place until this passage 36 again arrives at intake position in order to inject it into combustion chamber 2.

Figure 7:
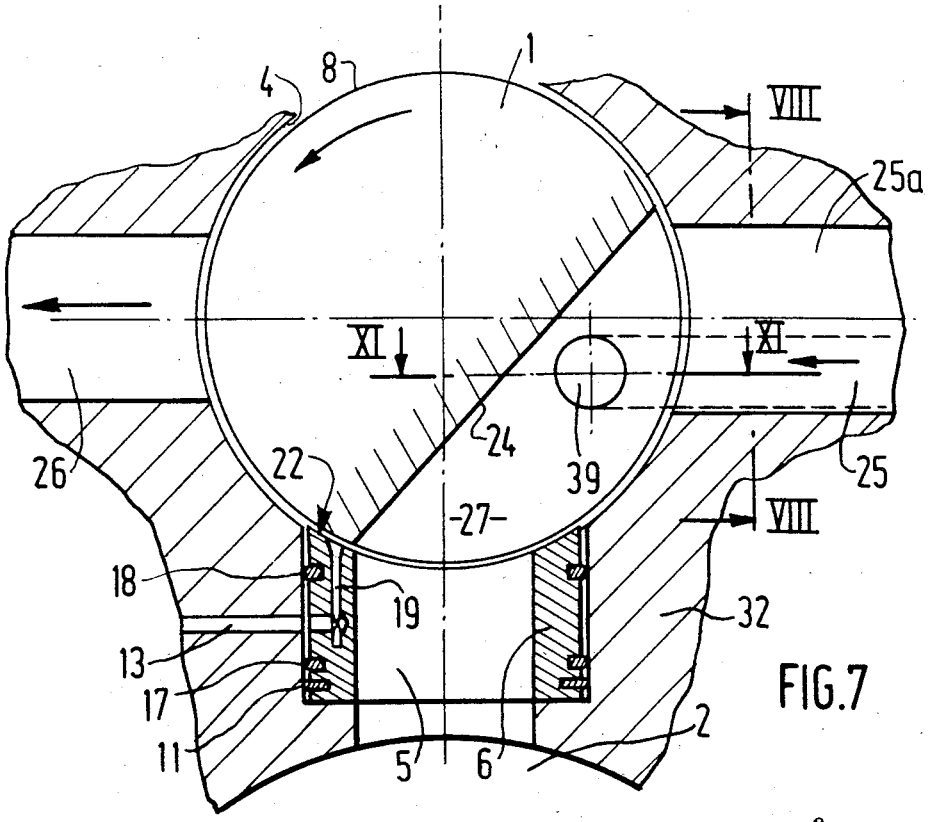
FIG. 7 is a cross-section view on a larger scale of a throttle distribution system in which are provided means for obtaining a lean mixture within the inducted air at the end of intake.
Figure 8:
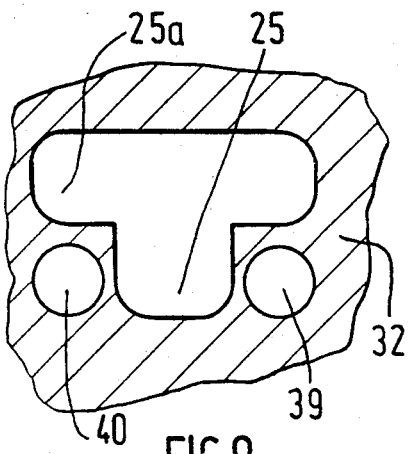
FIGS. 8 and 9 are respectively cross-sections according to lines VIII—VIII and IX—IX of the distribution system represented in FIG. 7.
Figure 9:
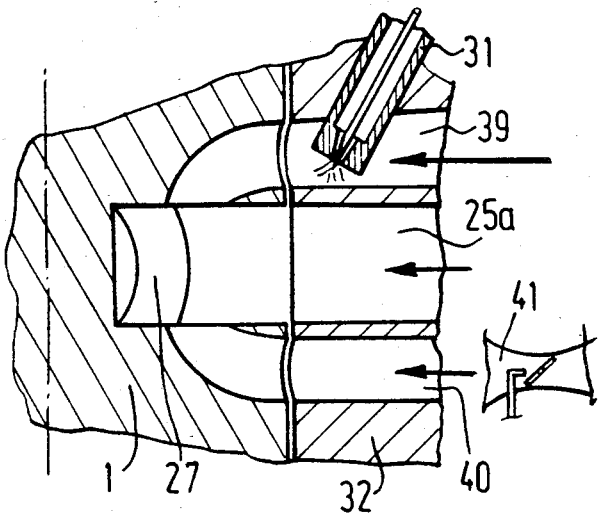

In the embodiment represented in FIGS. 7 to 9 and in which the elements and members identical to those of the preceding figures bear the same reference numerals, it is proposed to reduce considerably the richness in motor-fuel at the end of the intake period. With this purpose, intake pipe 25 represented in transverse cross-section in FIG. 8 and in longitudinal cross-section in FIG. 9, comprises two auxiliary feed passages 39 and 40 for a mixture rich in motor-fuel such as an air-gasoline emulsion mixture obtained by injection of gasoline through means of an injector 31 (pipe 39 in FIG. 9) or by an emulsion carburettor 41 (pipe 40 in FIG. 9). When the gasoline injection system is used, a single auxiliary pipe 39 is sufficient to ensure the correct proportion of motor-fuel.

In this embodiment, as will be seen from the section of FIG. 8, during rotation of throttle 1 during intake phase of a four stroke engine, auxiliary pipes 39 and 40 which are shut prior to enlarged part 25*a* of pipe 25 being shut and the sucked air at the end of injection on enlarged section 25*a* contains no motor-fuel and scavenges passage chamber 27 defined by notch 24 in order to evaporate and carry along almost all the liquid motor-fuel deposited on its walls, so that when this passage chamber is through-crossed by the exhaust gases, they only carry along a tiny quantity of the unused motor-fuel towards exhaust pipe 26.

Figure 10:
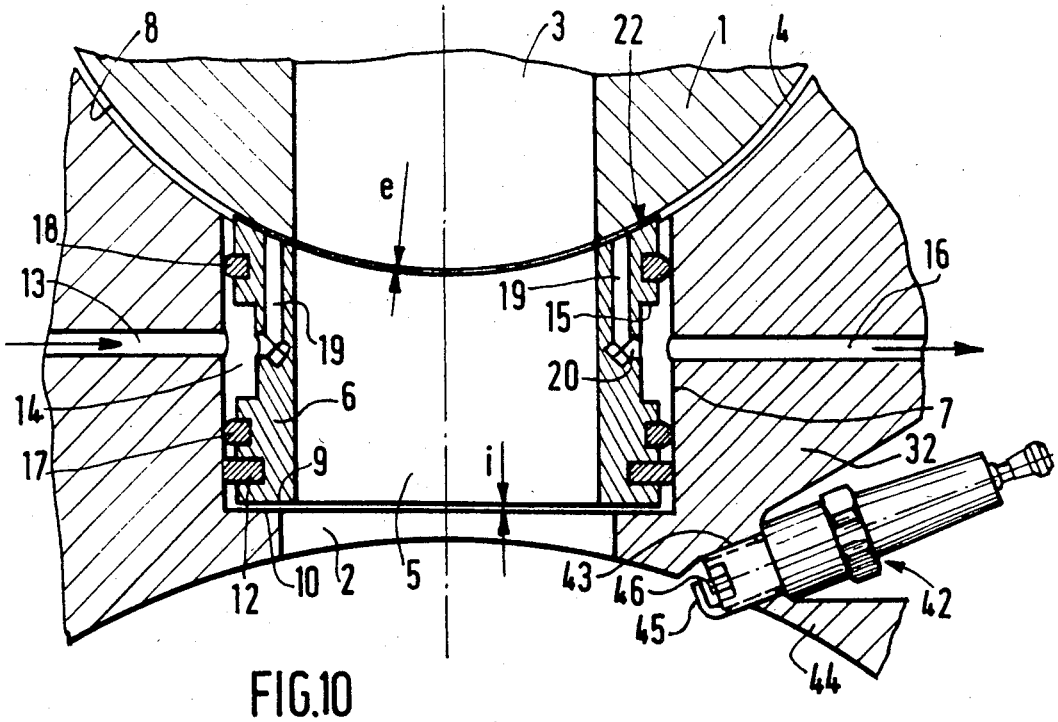
FIG. 10 is a cross-section view of the sealing system according to the invention comprising a sparking plug emerging into the combustion chamber.
Figure 11:
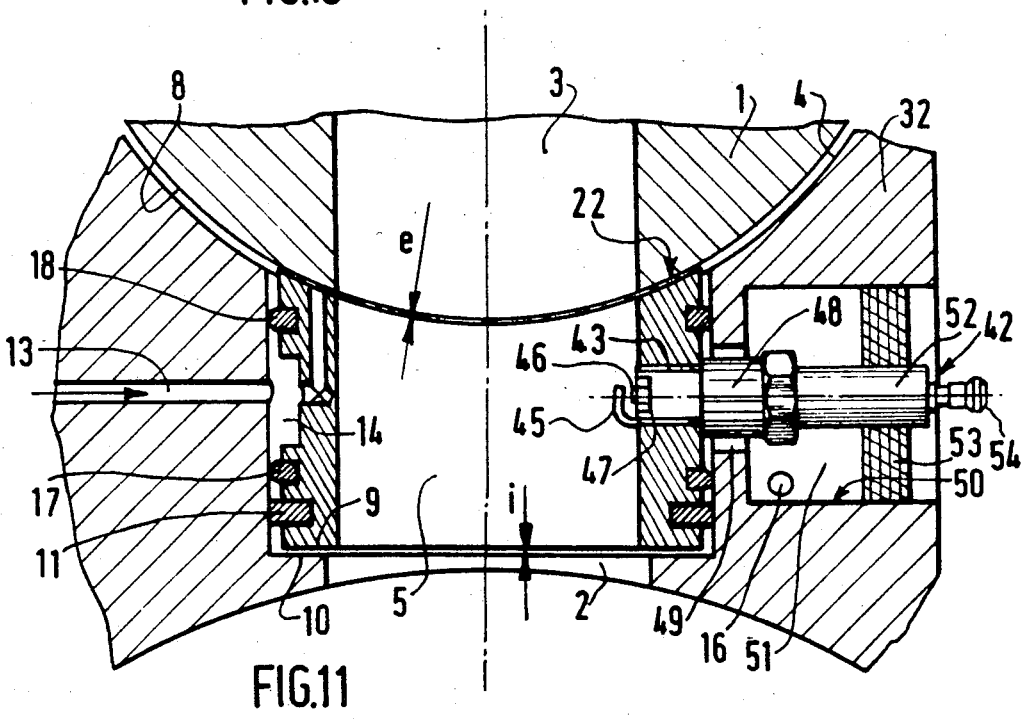
FIG. 11 is a cross-section view of the sealing system according to the invention comprising a sparking plug emerging directly into the passage of the sealing ring.

FIGS. 10 and 11 illustrate the assembly of a supply member connecting combustion chamber 2 to the outside and such as a sparking plug 42 utilized when the combustion engine is a controlled ignition internal combustion engine. In the case of a motor-fuel injection engine, such as a Diesel cycle engine, sparking plug 42 could be replaced by a motor-fuel injector or a pre-heating plug. The elements and members identical to those of the preceding figures bear, of course, the same reference numerals.

FIG. 10 shows that spark plug 42 is screwed into a thread 43 provided through a zone of thin wall 44 of cylinder head 32 of the engine, so that its electrodes 45 (connected to the ground) and 46 are slightly projecting inside combustion chamber 2. When an engine having a high compression ratio is used, the essential of the combustion chamber adjacent to the piston (not represented) at the end of its compression stroke is constituted by passage 5 of relatively large dimension provided in sealing ring 6. When spark plug 42 is placed in the position represented in FIG. 10 the ignition of the carburated mixture is carried out relatively unefficiently since it does not start up in central position with respect to the main volume of the combustion chamber at the end of a compression stroke.

FIG. 11 is a cross-section of a disposition of spark plug 42 (or wherever necessary, of a motor-fuel injector or a preheating plug) that overcomes the drawbacks of the assembly solution represented in FIG. 10. Packing ring 6 comprises between two intake passages 19 a thread 43 for receiving the end part or cap 47 of plug 42 which, in sealed assembly position through this thread through-crossing the transversal section of ring 6, is projecting by its electrodes 45 and 46 inside passage 5 adjacent to the wall but substantially at the centre of the main combustion chamber constituted by this passage 5.

Spark plug rod 48 that constitutes the part adjacent to cap 47 crosses with clearance a relatively narrow passage 49 provided through the wall of cylinder head 32. Passage 19 is connected to the outside by a bore of greater diameter forming an annular chamber 51 in which emerges output pipe 16. In order to shut annular chamber 51, a resilient annular seal 53 is interposed between the wall of bore 50 and cylindric insulator 52 of output terminal 54 of plug 42.

When the engine is running, a large oil flow and preferably previously cooled, is brought by pipe 13 and pressurizes annular distribution chamber 14 in order to cause to flow, via intake passages 19, a small lubricating oil flow in gap e between rotary throttle 1 and sealing surface 22 of ring 6. At the same time, a greater oil flow runs from chamber 14 to chamber 51 via narrow passage 49. This oil flow, which is thereafter evacuated at the feed-tank, cools ring 6 and plug 42 by acting in a most efficient way adjacent to the warmest part constituted by cap 47 and electrodes. The position of ring 6, with respect to rotary throttle 1, is adapted to vary in service following dilatation of ring 6, axial and radial variable pressure forces on this ring 6 and above all progressive wear of sealing surface 22 of this ring in rubbing contact with surface 8 of rotor 1, this wear causing gap or clearance i to vary. Instantaneous and progressive displacements (at each explosion) of ring 6 do not impair the sealing of chamber 51 and the position of the plug in cylinder head 32 due, on the one hand, to the clearance provided in passage 49 and preventing any contact between cylinder head 32 and plug rod 48 and, on the other hand, to the resilience of annular seal 53 preferably made of an elastomeric material. It will also be noted that if the embodiment of FIG. 11 is applied to a Diesel engine, the motor-fuel injector could be preferably cooled while the preheating plug must not be cooled or must be cooled as little as possible, which can be done by placing it in an insulating enveloppe.

The supply member assembly system represented in FIG. 11 carries out a mechanical and vibratory uncoupling between, on the one hand, sealing ring 6 that defines the essential of the combustion chamber at piston end of compression stroke and, on the other hand, cylinder head 32. Due to the dampening properties of the elastomer of seal 53 and annular seals 17 and 18, not only the eventual vibrations of ring 6 cannot be transmitted to the cylinder head and reciprocally but, furthermore, these vibrations are dampened at their critical frequency by the large elastomeric mass of seal 53.

For enhanced simplicity, it is of course, possible to mount plug 42 on thread 43 of ring 6 outside the cooling liquid circuit passing through annular chamber 14. In order to do this, it is sufficient that chamber 14 be, for example, placed adjacent to the upper end (on the drawing) of ring 6 and adjacent to gap e, the plug cap 47 being placed either close to the middle of the height of ring 6, or adjacent to combustion chamber 2.

Of course, the present invention is not limited to the embodiments, but it is adaptable to numerous variants available to the man skilled in the art, without departing from the spirit and scope of the invention.

I claim:

1. A device for controlling the circulation of gases to and from a combustion chamber of an internal combustion engine, comprising:

a sealing ring slidably positioned in a first bore of said engine such that a space is defined between said sealing ring and said bore, said sealing ring including a connecting orifice having one end in fluid communication with said chamber;

a transverse bore in fluid communication between an opposite end of said orifice and one of an intake and exhaust orifice;

a rotary throttle including a cut-out section defining a passage, said throttle positioned within said transverse bore and continuously revolving during operation, in synchronism with operation of the engine, to cyclically connect the connecting orifice with said passage;

at least one sealing element surrounding said sealing ring to prevent fluid flow within said space between said chamber and said passage;

said sealing ring normally biased in the direction of said rotary throttle by pressure in the combustion chamber; and fluid injection means for injecting a liquid in a gap between a sealing surface of the sealing ring and an external surface of said throttle via said space.

2. A device according to claim 1, applied to an internal combustion engine operating according to a four stroke cycle with feeding of motor-fuel occurring prior to intake of combustion air within the combustion chamber, and further including scraper means of lubricating fluid injected into the gap, disposed around the intake orifice connecting the throttle to the combustion air and motor-fuel intake, said scraper means including an intake sealing ring disposed at the periphery of the said intake orifice, continuously abutting upon the external surface of the throttle and adpated to shut fluid communication between the inside of the intake orifice and the gap between the throttle and said transverse bore in order to limit the carrying along of liquid to the surface of the rotating throttle.

3. A device according to claim 2, wherein the intake sealing ring is made of a soft material having good rubbing qualities with the external surface of the throttle and is continuously pushed against the external surface of the throttle under a substantially constant pressure by a spring.

4. A device according to claim 2, wherein the throttle comprises two separate intake and exhaust pipes, respectively, that are intended to emerge successively, through rotation of the throttle, (a) on the side of the combustion chamber, onto the sealing ring, and (b) from the opposite side onto output orifices, respectively, that are each shifted with respect to each other along the axis of the throttle with respect to the sealing ring, in such a way as to reduce the carrying along of the motor-fuel on the external surface of the rotating throttle and of the motor-fuel carried along the passage provided by the throttle.

5. A device according to claim 4, wherein the separate passages of two adjacent combustion chambers are provided in the throttle and emerge into a common orifice communicating with one of the intake and exhaust orifices and which is common to the two adjacent combustion chambers in such a way as to reduce the number of openings provided on the external surface of the throttle.

6. A device according to claim 1, and applied to a combustion engine operating according to a four stroke cycle, wherein an admission circuit of the combustion chamber comprises means for suppressing the amount of motor-fuel within the air inducted into the combustion chamber at the end of intake, in order to limit the quantity of motor-fuel introduced into the passage provided in the throttle and which has not entered within the combustion chamber during an intake phase.

7. A device according to claim 6, wherein in the case where the motor-fuel is introduced through injection into the intake air, said supression means including means for interrupting the motor-fuel injection well before the end of the intake phase.

8. A device according to claim 1, wherein an end portion of at least one supply member of a plug used for controlled ignition of the engine, sealingly passes through a the transverse section of the sealing ring in order to emerge into connecting orifice that is connected to the combustion chamber, and wherein an adjacent portion of said end is housed with annular clearance in a passage issuing towards the outside of a wall of a cylinder head of the combustion engine.

9. A device according to claim 8, wherein the passage giving rise to the annular clearance is through-crossed by a cooling liquid.

10. A device according to claim 9, wherein the cooling liquid is constituted by a lubricating and refrigerating liquid conveyed by the fluid injection means.

11. A device according to claim 1, wherein the fluid injection means includes an annular intake chamber defined in said space and bounded axially at opposite ends thereof by said at least one sealing element; and at least one feed passage in said sealing ring for fluidly connecting said annular intake chamber with said gap, wherein said liquid is supplied to said gap via said annular intake chamber and said at least one feed passage.

12. A device for controlling the circulation of gases to and from a combustion chamber of an internal combustion engine, comprising:

a sealing ring slidably positioned in a first bore of said engine such that a space is defined between said sealing ring and said bore, said sealing ring including a connecting orifice having one end in fluid communication with said chamber;

a transverse bore in fluid communication between an opposite end of said orifice and one of an intake and exhaust orifice;

a rotary throttle including a cut-out section defining a passage, said throttle positioned within said transverse bore and continuously revolving during operation, in synchronism with operation of the engine, to cyclically connect the connecting orifice with said passage;

at least one sealing element surrounding said sealing ring to prevent fluid flow within said space between said chamber and said passage;

said sealing ring normally biased in the direction of said rotary throttle by pressure in the combustion chamber;

fluid injection means for injecting a liquid in a gap between a sealing surface of the sealing ring and an external surface of said throttle via said space, and fluid injection means including an annular intake chamber defined in said space and bounded axially at opposite ends thereof by one said sealing element, and at least one feed passage in said sealing ring for fluidly connecting said annular intake chamber with said gap, wherein said liquid is supplied to said gap via said annular intake chamber and said at least one feed passage; and at least one fire ring interposed between the sealing ring and said first bore for protecting said at least one sealing ring and said annular intake chamber from heat from burned gases in the combustion chamber.

13. A device according to claim 11, wherein said sealing surface of the sealing ring includes a feed distribution groove facing the external surface of the throttle and fluidly connected with said at least one feed passage.

14. A device according to claim 13, wherein the fluid injection means includes means for regulating fluid flow through said at least one feed passage.

15. A device according to claim 14, wherein said means for regulating includes a porous annular cartridge positioned within said at least one feed passage and extending to said gap, said cartridge made of a material that provides good rubbing properties with the external surface of said throttle.

16. A device for controlling the circulation of gases to and from a combustion chamber of a four stroke cycle internal combustion engine, comprising:

a sealing ring slidably positioned in a first bore of said engine such that a space is defined between said sealing ring and said bore, said sealing ring including a connecting orifice having one end in fluid communication with said chamber;

a transverse bore in fluid communication between opposite end of said orifice and one of an intake and exhaust orifice;

a rotary throttle including a cut-out section defining a passage, said throttle positioned within said transverse bore and continuously revolving during operation, in synchronism with operation of the engine, to cyclically connect the connecting orifice with said passage;

at least one sealing element surrounding said sealing ring to prevent fluid flow within said space between said chamber and said passage;

said sealing ring normally biased in the direction of said rotary throttle by pressure in the combustion chamber;

fluid injection means for injecting a liquid in a gap between a sealing surface of the sealing ring and an external surface of said throttle via said space; and an admission circuit of the combustion chamber including means of suppressing the amount of motor-fuel within the air inducted into the combustion chamber at the end of intake, in order to limit the quantity of motor-fuel introduced into the passage provided in the throttle and which has not entered within the combustion chamber during an intake phase, said suppression means including means for interrupting the injection of motor-fuel into the intake air well before the end of the intake phase, said suppression means including at least one auxiliary passage of fuel enriched air provided in the throttle and the at least one auxiliary passage of fuel enriched air provided in the throttle and the at least one auxiliary passage emerging onto a gap between the throttle and its transverse bore at a point where it is shut by the rotation of the throttle prior to the intake orifice being in fluid communication with the throttle.

17. A device for controlling the circulation of gases to and from a combustion chamber of an internal combustion engine, comprising:

a sealing ring slidably positioned in a first bore of said engine such that a space is defined between said sealing ring and said bore, said sealing ring including a connecting orifice having one end in fluid communication with said chamber;

a transverse bore in fluid communication between an opposite end of said orifice and one of an intake and exhaust orifice;

a rotary throttle including a cut-out section defining a passage, said throttle positioned within said transverse bore and continuously revolving during operation, in synchronism with operation of the engine, to cyclically connect the connecting orifice with said passage;

at least one sealing element surrounding said sealing ring to present fluid flow within said space between said chamber and said passage;

said sealing ring normally biased in the direction of said rotary throttle by pressure in the combustion chamber;

fluid injection means for injecting a liquid in a gap between a sealing surface of the sealing ring and an external surface of said throttle via said space; and an end portion of at least one supply member of one of a plug used for controlled ignition of the engine, sealing passes through a transverse section of the sealing ring in order to emerge into the connecting orifice that is connected to the combustion chamber, and an adjacent portion of said end is housed with annular clearance in a passage issuing towards the outside of a wall of a cylinder head of the combustion engine, said passage giving rise to the annular clearance being through-crossed by a cooling liquid, and the passage giving rise to the annular clearance being extended towards the outside by an enlarged annular chamber, said enlarged annular chamber being sealed off by a resilient annular seal which is interposed between the supply member and an internal wall of said chamber and which defines a cooling chamber through crossed by a lubricating and cooling liquid conveyed by the fluid injection means.

* * * * *